US006523202B2

(12) United States Patent
Loomos

(10) Patent No.: US 6,523,202 B2
(45) Date of Patent: Feb. 25, 2003

(54) ERGONOMIC SEATING CUSHION

(76) Inventor: Melanie Loomos, 1925 Brickell Ave., Suite 1509, Miami, FL (US) 33129

( * ) Notice: Subject to any disclaimer, the term of this patent is extended or adjusted under 35 U.S.C. 154(b) by 0 days.

(21) Appl. No.: 09/802,611

(22) Filed: Mar. 9, 2001

(65) Prior Publication Data

US 2002/0124318 A1 Sep. 12, 2002

(51) Int. Cl.[7] ..... A47C 27/15
(52) U.S. Cl. ..... 5/653; 5/655.9; 5/944
(58) Field of Search ..... 5/653, 655.9, 740, 5/901, 902, 953, 724, 725, 727, 731, 736, 638, 652.1, 944; 297/452.26, 452.27

(56) References Cited

U.S. PATENT DOCUMENTS

| | | | | | |
|---|---|---|---|---|---|
| 2,384,713 | A | * | 9/1945 | Varma | 297/452.26 |
| 2,659,418 | A | * | 11/1953 | Berman | 267/145 |
| 3,258,791 | A | * | 7/1966 | Kaplan | 5/736 |
| 3,337,883 | A | * | 8/1967 | Allison | 5/638 |
| 3,366,106 | A | * | 1/1968 | Yao et al. | 5/638 X |
| 4,064,578 | A | * | 12/1977 | Yamada | 5/944 X |
| 4,132,228 | A | * | 1/1979 | Green | 601/57 |
| 4,276,666 | A | * | 7/1981 | Yamada | 5/736 |
| 4,504,050 | A | * | 3/1985 | Osborne | 5/637 |
| D278,779 | S | * | 5/1985 | Sink | 5/653 X |
| 4,620,337 | A | * | 11/1986 | Williams et al. | 5/736 X |
| 4,686,725 | A | * | 8/1987 | Mitchell | 5/736 X |
| 4,718,727 | A | * | 1/1988 | Sheppard | 5/653 X |
| 4,726,087 | A | * | 2/1988 | Schaefer et al. | 5/944 X |
| 4,741,058 | A | * | 5/1988 | Williams et al. | 5/736 X |
| 4,752,064 | A | * | 6/1988 | Voss | 5/638 |
| 4,777,855 | A | * | 10/1988 | Cohen | 5/901 X |
| D298,992 | S | * | 12/1988 | Voss | 5/638 X |
| 4,853,993 | A | * | 8/1989 | Walpin et al. | 5/901 X |
| 4,972,535 | A | * | 11/1990 | Goldman | 5/731 |
| 4,999,868 | A | * | 3/1991 | Kraft | 5/736 X |
| 5,134,735 | A | * | 8/1992 | Rose | 5/736 X |
| 5,136,740 | A | * | 8/1992 | Kraft | 5/727 X |
| 5,138,730 | A | * | 8/1992 | Masuda | 5/736 X |
| 5,163,194 | A | * | 11/1992 | Dixon | 5/901 X |
| 5,172,436 | A | * | 12/1992 | Masuda | 5/736 X |
| 5,230,110 | A | * | 7/1993 | Rose | 5/736 X |
| D337,914 | S | * | 8/1993 | McDonald | D6/601 |
| 5,327,597 | A | * | 7/1994 | Rothbard | 5/736 |
| D376,502 | S | * | 12/1996 | Bonaddio et al. | 5/901 X |
| 6,199,234 | B1 | * | 3/2001 | Srour et al. | 5/736 |
| 6,334,442 | B1 | * | 1/2002 | Altamura | 5/736 X |
| D456,516 | S | * | 4/2002 | Cheshaek et al. | D24/183 |
| 2002/0124318 | A1 | * | 9/2002 | Loomos | 5/653 |

FOREIGN PATENT DOCUMENTS

| | | | | | |
|---|---|---|---|---|---|
| DE | 3628325 | A | * | 2/1988 | 5/638 |
| DE | 3805980 | A | * | 9/1988 | 5/736 |
| GB | 2225229 | A | * | 5/1990 | 5/724 |
| JP | 362213706 | A | * | 9/1987 | 5/736 |
| WO | WO 90013245 | A | * | 11/1990 | 5/736 |

OTHER PUBLICATIONS

"The ProPillow", ProTechPacific, 1981.*

* cited by examiner

*Primary Examiner*—Robert G. Santos

(57) ABSTRACT

An ergonomic seating cushion has a central cavity whose interior boundaries form an oscillating waveform. This feature reduces the pressure gradient on skin pressing against the cushion, promoting blood flow to the region while maintaining a central area of little or no pressure upon the perineum area. The cushion may have a dimpled surface to further lower pressure gradients, and may be tilted forward to assist in increasing lordosis and reducing lower back pain, or rearward when used by pregnant women to assist in compensating for the weight of an unborn child during pregnancy.

20 Claims, 4 Drawing Sheets

ERGONOMIC SEATING CUSHION

BACKGROUND OF THE INVENTION

Modern society tends to promote sedentary lifestyles, in which office workers and others must perform their daily work while seated. Long periods of sitting are increasingly being identified as a major cause of lower back pain. Studies directed to that phenomenon have concluded that changes in the curvature of the spine that occur when a person sits down and remains seated for long lengths of time, are one cause of lower back pain. One such study is entitled *Ergonomics in the Design of Office Furniture*, by Kroemer, Ing, and Robinette, and published in Industrial Medicine, Vol. 38, No. 4 (April, 1969). Additional studies have been conducted to determine the extent of changes to spinal curvature that result from moving from a standing position to a seated position, and the effect upon the spine of seating posture and angle of recline when seated. Two typical studies are *Posture of the Trunk When Sitting on Forward Reclining Seats*, by Bendix and Biering-Sørensen, published in Scandinavian Journal of Rehabilitative Medicine, Vol 15 (1983); and The *Influence of Different Sitting Positions on Cervical and Lumbar Posture*, by Black, McClure and Polansky, published in SPINE, Vol. 21, No. 1 (1996).

Lumbar lordosis is the term commonly used to refer to the forward curve of the lumbar spine. In one study (*Lumbar Lordosis—Effects of Sitting and Standing*, by Lord, Small, Dinsay and Watkins, published in SPINE, Vol. 22, No. 21 (1997)), lordosis was measured as an angle between various identifiable points within the spine, with "total lordosis" being measured from the cephalad endplate of L1 to the cephalad endplate of S1. Other measurements from L2 and S1, from L4 to S1, and from L5 to S1 were also taken to determine the amount of curvature at each of the L1 locations, and the difference in curvature from standing to sitting. The results from that study are that lordosis increases by almost 50 percent when the patient moves from a sitting to a standing position, representing an angular change in total lordosis from 34±15 degrees when sitting to 49±15 degrees when standing. Since lower back pain and increased intradiscal pressure are associated with sitting over long periods of time, there has been an interest in alleviating or mitigating the problem by increasing lordosis when a subject is seated. Various attempts to do this have been proposed, and have led to ergonomically designed chairs having backs that provide lower back support for the lumbar spine. Another proposal has been that seats should be sloped forward to increase the forward tilt of the pelvis when seated. The Kroemer study, however, indicates that, while tilting the seat may increase forward pelvic tilt, also increasing lordosis, it also causes the body to slide forward. Such forward thrust must then be counterbalanced by action of the leg muscles, which ultimately becomes uncomfortable and fatiguing.

Other problems associated with sitting for long periods of time are documented in *Sitting Posture and Prevention of Pressure Ulcers*, by Defloor and Grypdonck, published in Applied Nursing Research, Vol. 12, No. 3 (August, 1999), *Shear vs Pressure as Causative Factors in Skin Blood Flow Occlusion* by Bennett, Kavner, Lee and Trainor, published in Arch Physical Medical Rehabilitation, Vol 60 (July, 1979), and *Hemorrhoids* by Nussain, published in Primary Care, Vol. 26, No. 1 (March, 1999), and include pressure ulcers, decreased blood flow, and aggravation of pre-existing hemorrhoids.

A different, but related problem involving low back pain is frequently experienced by pregnant women. Here, however, the pain may be related to increased lordosis, which can be the result of changes in the center of gravity caused by the added weight of the growing baby in a location that is forward of the body's normal center of gravity. The added weight requires the mother to adjust her posture to balance and compensate for the added weight. Such adjustment affects both the standing posture and the seated posture. In addition, studies such as *Venous Dynamics—Vericosities*, by Sumner, published in Clinical Obstetrics and Gynecology, Vol. 24, No. 3 (September 1981) have determined that two-thirds of women in and after their $29^{th}$ week of pregnancy experience compression of the right iliac artery at the most prominent point of lumbar lordosis. Potential adverse effects resulting from this blood flow restriction, and on related restricted venous outflow, include interference with fetoplacental nutrition, which is nutrition pertinent to the fetus and its placenta, and decreased blood return to the mother's heart. Traditional methods of treating these conditions have used physical therapy. However, it does not appear that attempts to alleviate these conditions through the use of an ergonomic seat cushion designed to decrease lordosis in pregnant women, and to improve arterial and venous blood flow in the iliac and pelvic areas, have heretofore been made. The pain and symptoms associated with these conditions may be alleviated by one or more embodiments of the present invention.

A pillow for alleviating pain associated with hemorrhoids and other tenderness in the perineum area has been patented by the inventor in U.S. Pat. No. 6,018,831 to Loomos, and consists of a pillow having foam layers of varying density on either side of a center cavity. The topmost layer extends partially over the cavity on either side, creating a cantilever effect that reduces the pressure gradient upon the body at the transition line separating the foam support layers from the central cavity. This invention, however, does not address the problems of reduced lordosis while seated, nor of occluded blood flow to the skin that results from pressure applied to the skin of the buttocks and perineum areas when seated. While the cantilevered topmost foam layer taught by Loomos does tend to modify the pressure gradient that exists between the foam layered portion of the pillow and the central cavity, the problem is not totally alleviated because the cantilevered design creates a narrow, well-defined perimeter of shear force at the margin between the central cavity and the surrounding foam support layers. This shear force causes a high pressure gradient that tends to occlude skin blood flow into and across skin areas adjacent to that perimeter.

SUMMARY OF THE INVENTION

In one embodiment, the ergonomic seating cushion of this invention combines a forward tilt, which tends to increase lordosis, with a dimpled upper surface and a cavity extending through the upper surface. As used in this disclosure, a "dimpled surface" shall refer to a three dimensional surface having elevations and depressions. The interior margins of the cavity below the upper surface are in the shape of an oscillating waveform. The dimpled upper surface and waveform margins reduce large pressure gradients and promote satisfactory skin blood flow to the buttocks, perineum area, and legs. By using foam layers of varying firmness and thickness, an ideal combination of comfort and therapeutic effect may be achieved.

In another embodiment, the cushion is fashioned to create a backward tilt which is designed to tilt the pelvis rearward.

Such a design assists pregnant women to overcome the increased lordosis that is caused by a growing baby. The internal configuration of the cushion is similar to that of a forward-tilting cushion, and will decrease the incidence of compression of the right iliac artery and of decreased venous outflow, described above. In this design, other features of the invention have the same beneficial effects described below, yet the tilt to the rear provides additional support for the spine when sitting that largely compensates for changes in the mother's center of gravity.

Because individuals have different degrees of natural lordosis, and will tolerate different amounts of tilt before experiencing discomfort, the cushion of this invention is intended to be custom made or mass produced; and when custom made, may be given any amount of forward or backward tilt, including no tilt at all, as desired by the intended user.

The upper surface of the cushion of this invention is dimpled to create variances in the pressure gradients experienced by skin immediately adjacent to the cushion surface. Dimples in a foam layer having trough to crest heights of 1 to 2 cm, and that are spaced apart between 2 to 4 cm, create an ideal surface for limiting the amount of skin within a local area that could experience an occluded blood flow. On such a surface, very minor readjustments of seating position will produce large changes in pressure gradients, thereby ensuring that blood flow will reach all areas subject to surface pressures induced by sitting.

As taught by Loomos, a central cavity is provided to eliminate the pressure of sitting upon the perineum area, thereby minimizing or removing the pain and discomfort associated with hemorrhoids and other conditions. In the present invention, the perimeter of the cavity in which shear forces tend to create high pressure gradients is cut to form a series of oscillating waves, which have the effect of varying the margin and minimizing the pressure gradient experienced by the skin adjacent the cavity margin. By minimizing the pressure gradient, lower peak surface pressures are created, and skin blood flow is improved.

The cushion may be tilted forward slightly, to tilt the pelvis and assist in attaining a larger lordosis than would otherwise be present. A forward tilt of between 3 degrees and 10 degrees should be most effective, although actual tilt may be either lesser or greater, and will ultimately be determined by personal comfort and preference. The cushion is normally covered by a fabric, and a fabric should be chosen that exhibits high static friction on both sides. The combination of a dimpled upper surface and high static friction fabric will assist in maintaining the proper posture without sliding forward off the cushion. In the preferred embodiment, three foam layers are used, although embodiments having only two layers are also disclosed. The topmost layer will have an ovoid or elongated cavity, and will be immediately superjacent a middle foam layer having a cavity that is slightly larger than the cavity in the topmost layer. The cavity in the middle layer will have oscillating waveform margins, and the foam will normally be somewhat firmer than that used for the top layer. Also in the preferred embodiment, the middle layer will rest atop a bottom layer. The bottom layer has no cavity, and is intended to provide strength and structure to the cushion. In order to form a tilt, any one or more of the layers may be formed in the shape of a wedge. In the preferred embodiment, the middle layer is shaped like a wedge with an increasing thickness from front to back, the angle of the wedge becoming the angle of tilt.

DETAILED DESCRIPTION OF THE DRAWINGS

Figure 1:
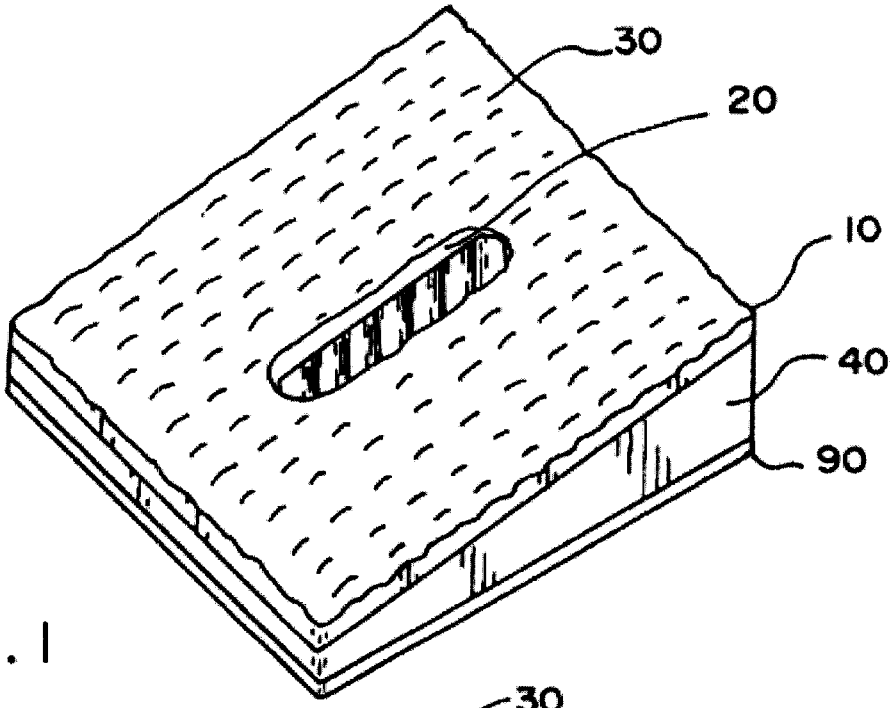
FIG. 1 is top perspective view of the cushion having a dimpled top layer.

One embodiment of the cushion of this invention is a three-layer cushion made of foam or some other suitable material, as depicted in FIG. 1. A topmost layer 10 has an ovoid or elongate cavity 20 running along a central front-to-back axis. Dimples 30 may be applied to or formed upon the uppermost surface of the topmost layer to provide varying pressure gradients to adjacent skin when the cushion is being used as a seat cushion. Such varying pressure gradients limit the size of local areas in which pressure on the skin may reduce blood flow within the area. Upon a very slight shifting or changing of position, the dimples will impact and apply pressure to other skin areas, thereby assuring that no one skin area is deprived of adequate blood flow for extended periods of time. Although FIG. 1 depicts a cushion without a cover, it is anticipated that an outer covering of fabric or some other suitable material will be used, both to protect the cushion from wear and tear, and to provide a comfortable interface with the person using the cushion.

Figure 2:
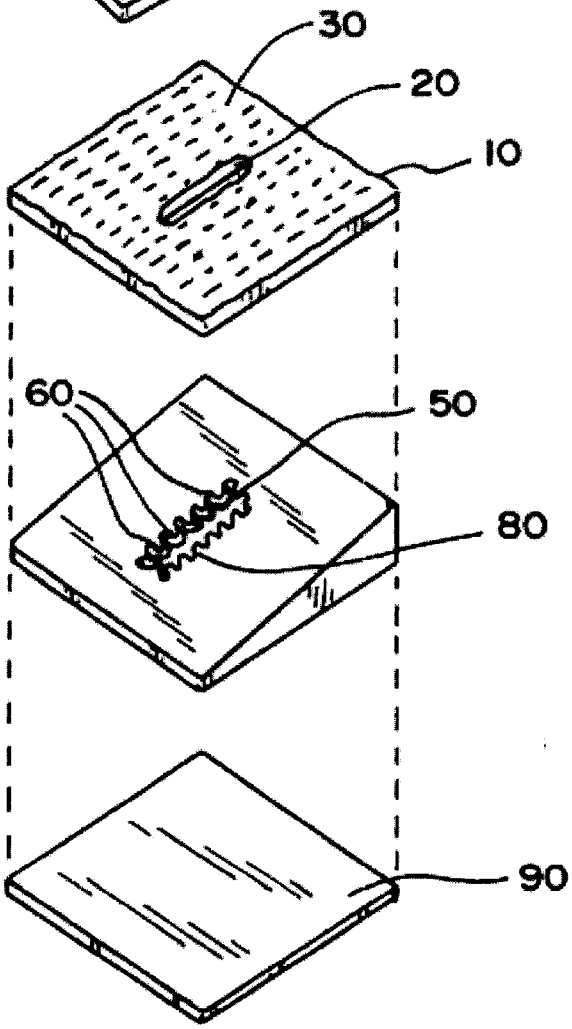
FIG. 2 is an exploded perspective view of the dimpled cushion.
Figure 3A:
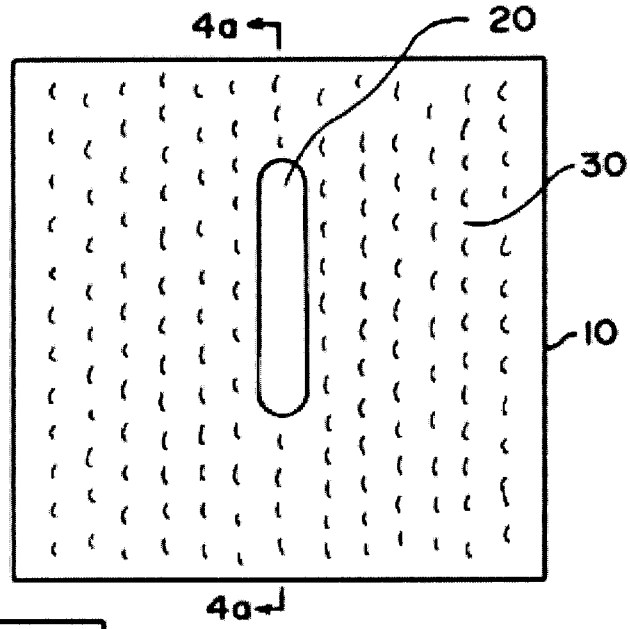
FIG. 3*a* is a plan view of the topmost layer.
Figure 3B:
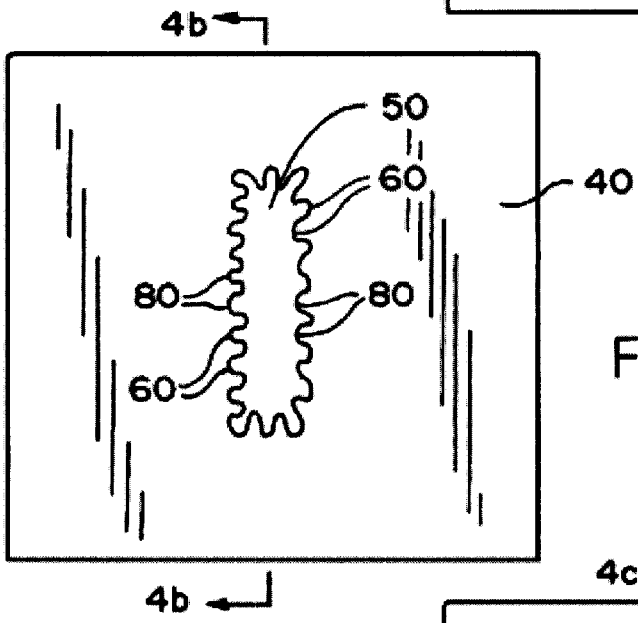
FIG. 3*b* is a plan view of the middle layer.
Figure 3C:
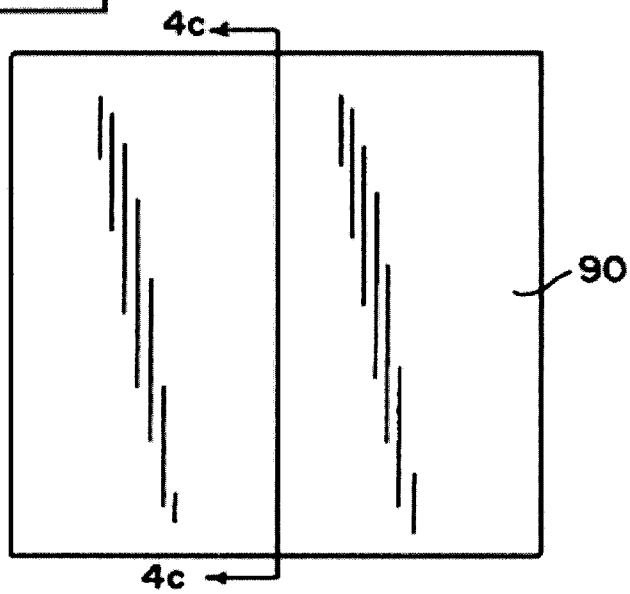
FIG. 3*c* is a plan view of the bottom layer.
Figure 4A:
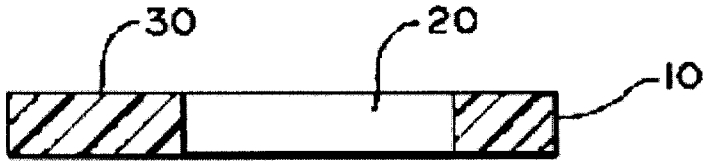
FIG. 4*a* is a right sectional view of the topmost layer.

As shown in FIG. 2, the topmost layer 10 fits immediately superjacent to a middle layer 40, and is permanently affixed thereto. FIG. 3*a* shows the ovoid or elongated cavity 20 in the topmost layer. As shown, the cavity occupies slightly more than one-half of the length of the cushion from front to back. The lateral margins of the cavity 20 in the topmost layer are smooth and generally straight or slightly curved. However, the specific size and shape of the cavity 20 is unimportant to the operation of the invention, and other cavity sizes and shapes may be appropriate where the physiognomy of the specific user so dictates. The cavity is designed to create an area in which no surface pressure will be exerted upon sore or painful bodily tissue, and the shape and size of the cavity may be varied as necessary to achieve this result without departing from the spirit of the invention. As shown in FIG. 4*a*, the topmost layer generally has a constant thickness throughout, with the exception of the topmost surface which has dimples 30 consisting of peaks and valleys. However, the topmost layer may also be shaped like a wedge 70, either to provide a tilt to the cushion or to compensate for or modify the effects of another layer's having been given a wedge shape.

A middle layer 40 is formed of material that normally will be more dense and less flexible than the material of the topmost layer. The middle layer includes a cavity 50 that is subjacent to the cavity formed in the topmost layer. The margins of the cavity of the middle layer form shapes of oscillating waves 60. The purpose for an oscillating margin is to diffuse the pressure caused by a person's weight across a larger skin area than would occur if straight margins defined the cavity. By diffusing the pressure, the irregular edge 60 causes lower peak pressures to be exerted upon adjacent skin, thereby enhancing blood flow to those areas, and reducing the deleterious effects upon health that maybe caused by limited blood flow. The oscillating boundary must have adjacent peaks sufficiently close to one another to support the topmost layer and the weight of a person sitting on the cushion while also having sufficient depth between adjacent peaks and troughs 80 to provide a significant area for diffusion of the pressure that will be passed through the topmost layer and experienced on the skin of the person seated on the cushion.

Figure 4B:
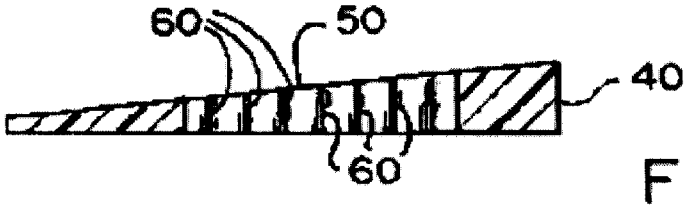
FIG. 4*b* is a right sectional view of the middle layer.
Figure 4C:
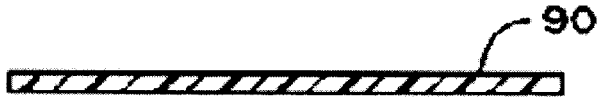
FIG. 4*c* is a right sectional view of the bottom layer.
Figure 5:
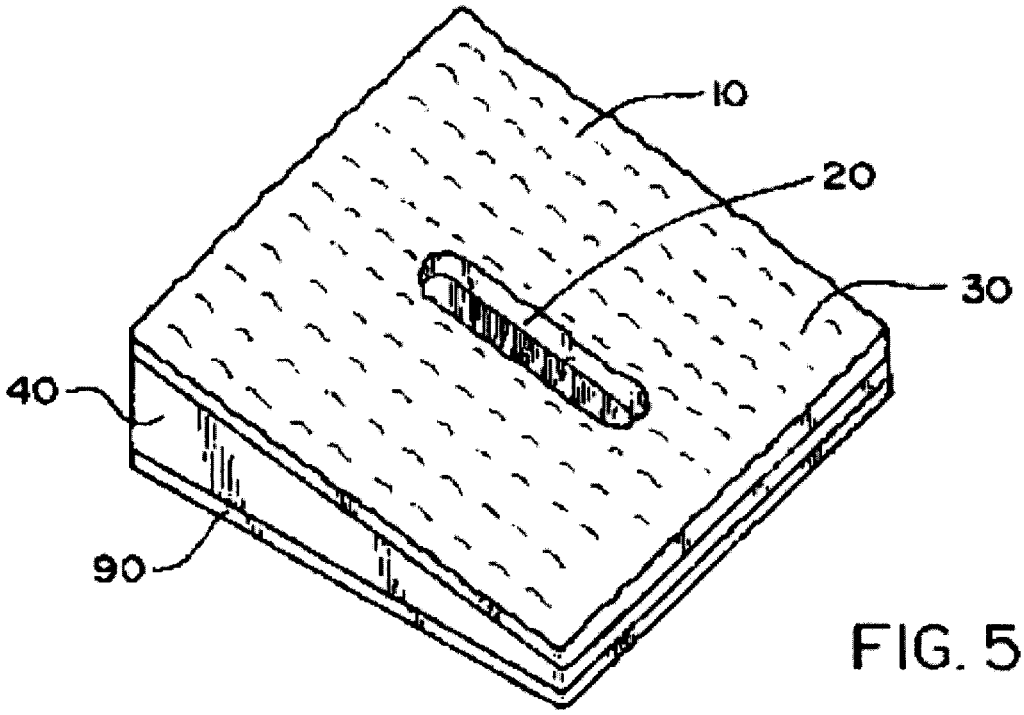
FIG. 5 is a perspective view of an alternative embodiment of the cushion having a rearward tilt.
Figure 6:
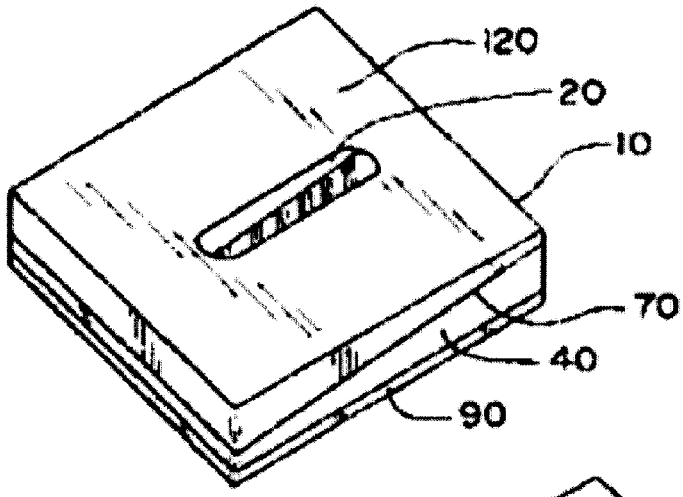
FIG. 6 is a perspective view of an alternative embodiment of the three layer cushion having opposite facing wedge shapes for the top two layers, the topmost layer having a smooth surface.

Although, in the preferred embodiment, the middle layer is given a wedge shape, any layer may be configured to have a different heights at the front and at the back, thereby causing the cushion to have a tilt. FIGS. 1, 2, and 4*b* show a configuration in which the middle layer is shaped like a wedge pointing forward, giving the cushion a forward tilt. FIG. 5 shows the cushion having a reverse tilt. An embodiment in which layers are given counteracting wedge shapes is shown in FIG. 6. A configuration such as this may be used with layers of varying firmness to provide a tilting effect when sat upon while otherwise appearing to be "flat." Various combinations of wedge shapes and material firmness maybe used where it is desired to provide greater firmness in one part of the cushion and less in another.

While it may be possible for the same cushion to be used to provide both a forward and a rearward tilt, simply by turning the cushion around, the normal placement of the center cavity 20 nearer to the rear of the cushion, as shown in FIG. 3*a*, may make the cushion unsuitable or uncomfortable for this use where it is simply turned around. However, the cushion can be manufactured such that the center cavity is centered from front to back, thereby alleviating this circumstance. When the cushion is used in a tilt-back configuration, it may also be desirable to mold the forward edge slightly, to ease shear pressure on the underside of the legs at the edge of the cushion.

The bottom layer 90 for the cushion is affixed to the middle layer immediately above it, and provides structure and form to prevent the middle and topmost layers from becoming distorted due to lack of internal structure in the cavity area of those layers. The bottom cushion may be firmer, less firm, or of the same firmness as the middle layer, and will generally have a thickness commensurate with its firmness. However, under special circumstances, the bottom layer may be configured on its bottom surface to meet an irregular configuration of the seat of the chair upon which it is to be used. Such could be the case, for example, if the cushion of this invention were to be used as a seating cushion integral to a chair, lounger, or couch.

FIG. 6 shows an embodiment of the three layered cushion in which the topmost surface is not dimpled 120. Many materials used for upper surfaces or topmost layers have sufficient rigidity that dimples formed in them would cause the seating area to become uncomfortable. When such materials are used, an alternative embodiment may be made without dimples.

Figure 7:
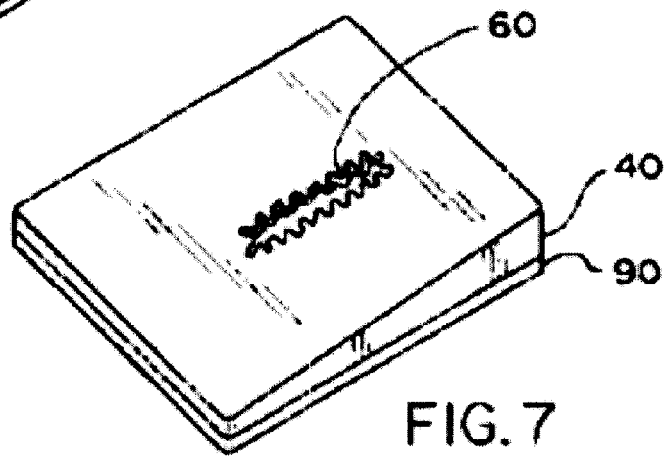
FIG. 7 is a perspective view of a two layer embodiment of the cushion.

FIG. 7 depicts an alternative embodiment of the cushion in which there are only two layers. Although the upper surface is shown as smooth in FIG. 7, dimples may be added under conditions of a relatively flexible upper surface. In this configuration, the upper layer contains a cavity having margins in the form of oscillating waves 60. A lower layer provides strength and form to the cushion. As with other embodiments, the cushion may be constructed with a forward or backward tilt, or with no tilt at all. This embodiment has the advantage of being able to be made more cheaply or more quickly than embodiments having three layers, yet will exhibit the same beneficial features as the three layered embodiments.

Figure 8:
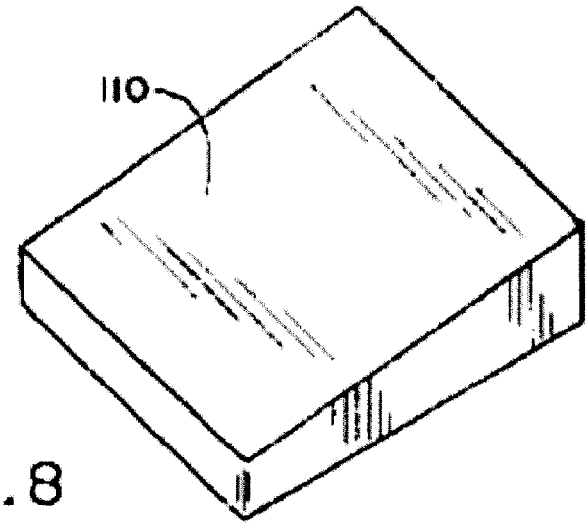
FIG. 8 is a perspective view of the cushion covered with fabric.

The cushion of this invention may be covered with fabric or some other covering material, as shown in FIG. 8. Fabric 110 may constitute a porous material to permit air to pass through the fabric, and may exhibit a high static friction intended to resist a user from sliding forward when a high angle of forward tilt is used. The covering not only provides an esthetically pleasing form for the cushion of this invention, but may also be adapted to receive a carrying handle to make transporting the cushion less awkward.

Figure 9:
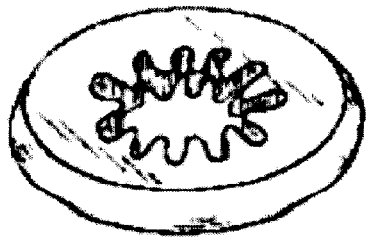
FIG. 9 is a perspective view of a single layer, rounded perimeter embodiment of the invention.

Yet another embodiment of the cushion is shown in FIG. 9. As is there depicted, an interior cavity having an oscillating waveform can be used in a single layer cushion, and the perimeter of such a cushion need not be square, but may be oval, elliptical, or circular in shape. In each embodiment of the invention, it is the oscillating vertical surface of the interior cavity that reduces the pressure gradients upon the body near the center of the cushion, thereby promoting blood flow to the region. A single layer cushion may also be wedge shaped in order to improve posture.

It will be understood by persons of skill in the art that the foregoing embodiments and descriptions are exemplary of the invention, and should not be regarded as limiting either the scope or the spirit of the invention, which is claimed herein.

What is claimed is:

1. A seating cushion comprising one or more layers of compressible material, at least one said layer having an interior cavity with an interior vertical surface, said interior vertical surface forming a continuous substantially sinusoidal oscillating waveform.

2. A seating cushion as claimed in claim 1 wherein said interior cavity extends through at least one said layer.

3. A seating cushion as claimed in claim 1 wherein the upper surface of said cushion is dimpled.

4. A seating cushion as claimed in claim 1 in which at least one said layer has a wedge shape.

5. A seating cushion as claimed in claim 1 wherein the seating surface of said cushion is tilted forward.

6. A seating cushion as claimed in claim 1 wherein the seating surface of said cushion is tilted backwards.

7. A seating cushion as claimed in claim 1 in which said cushion is covered with an outer coating.

8. A seating cushion as claimed in claim 1 in which said cushion has four sides, a top surface, and a bottom surface.

9. A seating cushion as claimed in claim 1 in which said cushion has a top surface, a bottom surface, and a rounded perimeter.

10. A seating cushion comprising a plurality of layers, at least one of said layers being of compressible material, the topmost of said layers having an opening therethrough, a second layer being subjacent to said topmost layer, said second layer having an interior cavity therein, said interior cavity having an opening proximate to said elongate opening and having an interior surface having vertical portions, said vertical portions forming a continuous substantially sinusoidal oscillating waveform.

11. A seating cushion as claimed in claim 10 wherein said opening is elongate.

12. A seating cushion as claimed in claim 10 wherein said opening of said interior cavity is larger than said opening through said topmost layer such that at least a portion of said topmost layer extends over said opening of said interior cavity.

13. A seating cushion as claimed in claim 12 in which said the hole through said topmost layer is above said opening of said interior cavity such that the perimeter of said opening through said topmost layer is cantilevered above said opening of said interior cavity.

14. A seating cushion as claimed in claim 12 wherein the upper surface of said cushion is dimpled.

15. A seating cushion as claimed in claim 12 in which at least one said layer has a wedge shape.

16. A seating cushion as claimed in claim 12 wherein the seating surface of said cushion is tilted forward.

17. A seating cushion as claimed in claim 12 wherein the seating surface of said cushion is tilted backwards.

18. A seating cushion as claimed in claim 12 in which at least two of said layers are made from a compressible materials having different degrees of compressibility.

19. A seating cushion as claimed in claim 12 in which said cushion has four sides, a top surface, and a bottom surface.

20. A seating cushion as claimed in claim 12 in which said cushion has a top surface, a bottom surface, and a rounded perimeter.

* * * * *